US009805685B2

(12) United States Patent
Lin et al.

(10) Patent No.: US 9,805,685 B2
(45) Date of Patent: Oct. 31, 2017

(54) DISPLAY CONTROLLER, VIDEO SIGNAL TRANSMITTING METHOD AND SYSTEM THEREOF FOR TRANSMITTING VIDEO SIGNALS WITH MULTIPLE DATA RATE AND REDUCED NUMBERS OF SIGNALS LINE

(75) Inventors: Chen-Nan Lin, Hsinchu Hsien (TW); Ming-Chieh Yeh, Hsinchu Hsien (TW); Chun Wen Yeh, Hsinchu Hsien (TW); Chun-Chia Chen, Hsinchu Hsien (TW)

(73) Assignee: MSTAR SEMICONDUCTOR, INC., Hsinchu Hsien (TW)

( * ) Notice: Subject to any disclaimer, the term of this patent is extended or adjusted under 35 U.S.C. 154(b) by 719 days.

(21) Appl. No.: 12/822,914

(22) Filed: Jun. 24, 2010

(65) Prior Publication Data

US 2011/0001768 A1 Jan. 6, 2011

(30) Foreign Application Priority Data

Jul. 1, 2009 (TW) ..... 98122253 A

(51) Int. Cl.
*G09G 3/36* (2006.01)

(52) U.S. Cl.
CPC ..... *G09G 3/3685* (2013.01); *G09G 2310/027* (2013.01); *G09G 2310/0221* (2013.01); *G09G 2352/00* (2013.01)

(58) Field of Classification Search
USPC ..... 345/698
See application file for complete search history.

(56) References Cited

U.S. PATENT DOCUMENTS

| | | | | |
|---|---|---|---|---|
| 4,878,117 | A * | 10/1989 | Ikehira | G06F 3/14 348/565 |
| 5,612,715 | A * | 3/1997 | Karaki et al. | 345/698 |
| 5,917,552 | A * | 6/1999 | Van Court | G09G 5/003 348/555 |
| 5,923,307 | A * | 7/1999 | Hogle, IV | 345/4 |
| 7,158,094 | B2 * | 1/2007 | Wilks | 345/1.1 |
| 7,525,511 | B2 * | 4/2009 | Baudisch | 345/1.3 |
| 2005/0156862 | A1 * | 7/2005 | Hirayama | G09G 3/3677 345/100 |
| 2006/0214873 | A1 * | 9/2006 | Park | G09G 5/006 345/1.1 |
| 2007/0024645 | A1 * | 2/2007 | Purcell et al. | 345/634 |

* cited by examiner

*Primary Examiner* — David D Davis
(74) *Attorney, Agent, or Firm* — Han IP Corporation

(57) ABSTRACT

A display controller, video signal transmitting method and system thereof are provided. The display controller includes a processing circuit; a transmitting channel, coupled to the processing circuit; a receiving channel, coupled to the processing circuit; and a clock generator, that generates an internal clock signal and an external clock signal. Upon receiving a video signal, the processing circuit processes a first partial pixel data of the video signal to output a first display control signal. The transmitting channel converts a second partial pixel data of the video signal to a partial video signal having a multiple data rate according to the internal clock signal to be outputted.

14 Claims, 9 Drawing Sheets

DISPLAY CONTROLLER, VIDEO SIGNAL TRANSMITTING METHOD AND SYSTEM THEREOF FOR TRANSMITTING VIDEO SIGNALS WITH MULTIPLE DATA RATE AND REDUCED NUMBERS OF SIGNALS LINE

CROSS REFERENCE TO RELATED PATENT APPLICATIONS

This patent application claims priority from Taiwan Patent Application No. 098122253, filed in the Taiwan Patent Office on Jul. 1, 2009, entitled "Display Controller, Video Signal Transmitting Method and System Thereof", and incorporates the Taiwan patent application in its entirety by reference.

TECHNICAL FIELD

The present disclosure relates to a display controller, a video signal transmitting method and a system thereof, and more particularly, to a display controller with a multiple data rate, and a video signal transmitting method and a system thereof.

BACKGROUND OF THE PRESENT DISCLOSURE

FIG. 1 shows a schematic diagram of a conventional liquid crystal display (LCD) system that comprises an LCD panel 100 and a display controller 130. The LCD panel 100 is divided into a display area 112 and a non-display area 114. The display area 112 comprises a thin film transistor (TFT) array, and the non-display area 114 comprises a gate driver 120 and a source driver 125 to control transistors in the TFT array. The display controller 130 outputs a display control signal for controlling the gate driver 120 and the source driver 125, so as to respectively generate a gate driving signal for controlling the TFT array, and a source driving signal for controlling brightness of displayed pixels.

The display controller 130 receives and processes a video signal to generate a display control signal that is transmitted to the LCD panel 100. The display control signal comprises a vertical synchronization signal Vsync, a horizontal synchronization signal Hsync, a red signal Red, a green signal Green, and a blue signal Blue.

A time period for displaying a scan line on the LCD panel is a cycle of the horizontal synchronization signal Hsync, and a time period for displaying a frame on the display area 112 of the LCD panel is a cycle of the vertical synchronization signal Vsync.

Along with increases in the size and resolution of LCD panels as well as an update rate of a display video, the number of display control signals is also increased, such that a processing speed of a single display controller no longer meets real-time requirements for processing video signals or generating display control signals. Therefore, a solution to a large-scale LCD with high resolution needs to be developed.

SUMMARY OF THE PRESENT DISCLOSURE

One object of the present disclosure is to provide a display controller, and a video signal transmitting method and a system thereof to transmit a partial video signal between the display controllers with a multiple data rate, such that signals required by the partial video signal are reduced and thereby reducing the number of pins of the display controllers.

The present disclosure describes a display controller comprising a processing circuit; a transmitting channel, coupled to the processing circuit; a receiving channel, coupled to the processing circuit; and a clock generator, for generating an internal clock signal and an external clock signal. The processing circuit receives a video signal, and generates a first display control signal according a first partial pixel data of the video signal. The transmitting channel converts a second partial pixel data of the video signal to a partial video signal that is outputted with a multiple data rate with reference to the internal clock signal. The partial video signal is outputted together with the external clock signal by the clock generator.

The present disclosure further describes a video signal transmitting method, applied to a first display controller and a second display controller, comprising receiving a video signal via the first display controller; converting a first partial pixel data of the video signal to a first display control signal to be outputted by the first display controller; generating a clock signal; and processing a second partial pixel data of the video signal to a partial video signal to be outputted together with the clock signal by the first display controller.

The present disclosure further describes a display system comprising a first display controller, for receiving a video signal and converting a first partial pixel data of the video signal to a first display control signal to be outputted, and converting according to an internal clock signal a second partial pixel data of the video signal to a partial video signal, which is to be outputted together with an external clock signal; a second display controller, for receiving the partial video signal and the external clock signal, converting the partial video signal to the second partial pixel data, and converting the second partial data to a second display control signal to be outputted; and an LCD panel, for displaying a frame according to the first display control signal and the second display control signal.

Following description and drawings are provided to enable a better understanding of the advantages of the present disclosure.

DETAILED DESCRIPTION OF THE PREFERRED EMBODIMENT

Figure 1:
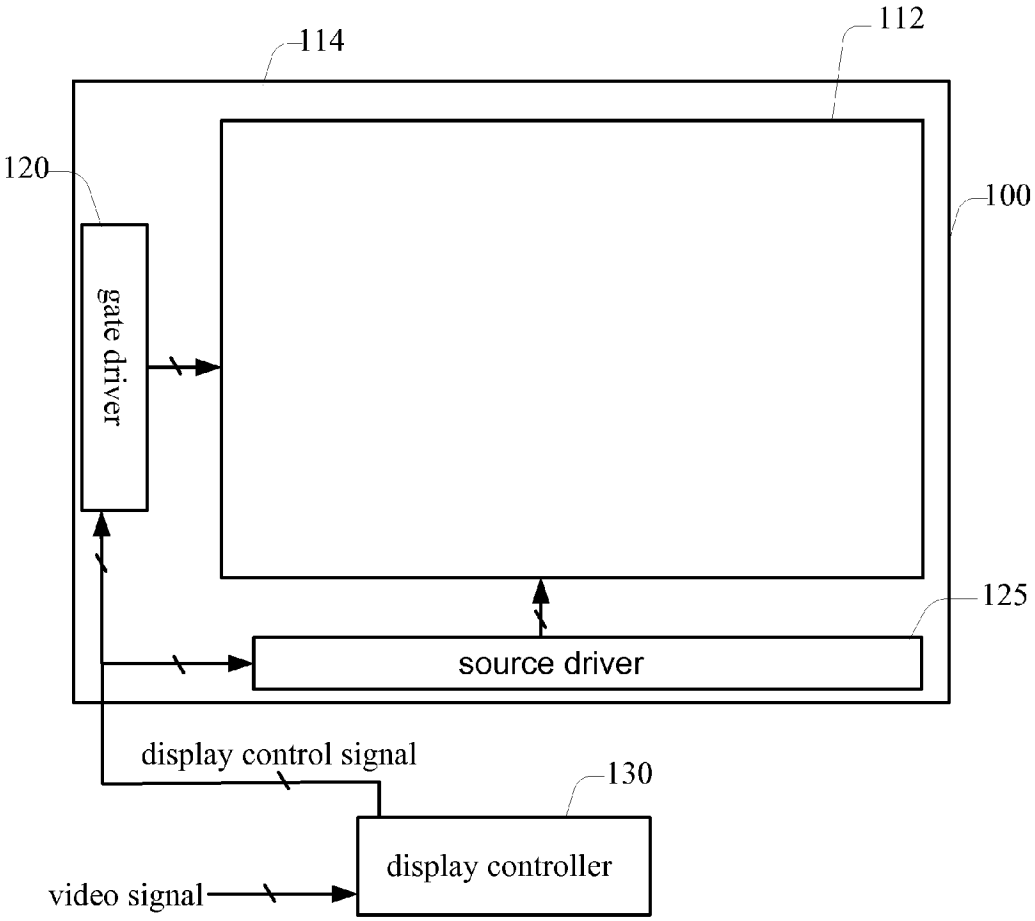
FIG. 1 (Prior Art)
FIG. 1 is a schematic diagram of a conventional LCD system.
Figure 2:
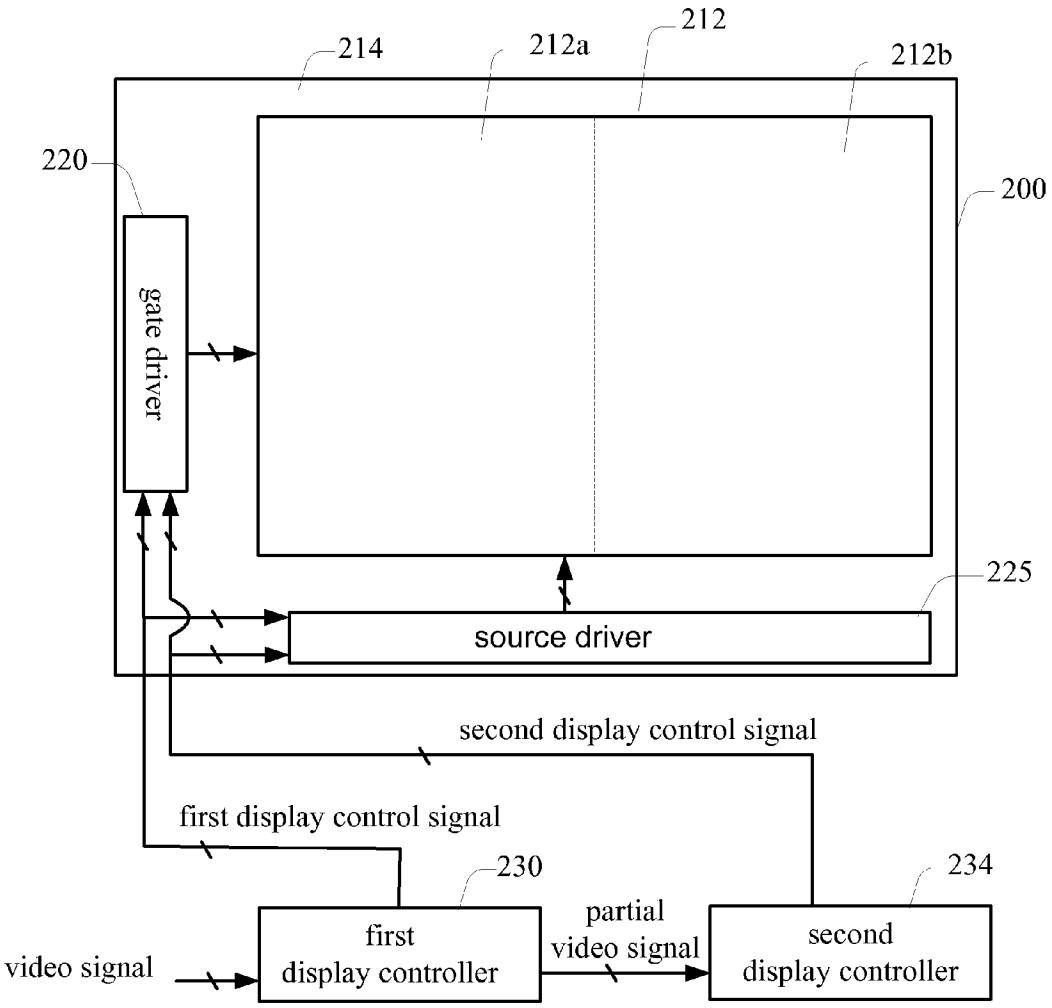
FIG. 2 is a schematic diagram of a large-scale LCD system.

In this embodiment, multiple display controllers are applied to achieve a video display of a large-scale LCD panel. FIG. 2 shows a schematic diagram of a large-scale LCD system comprising an LCD panel 200, a first display controller 230, and a second display controller 234. A display area 212 of the LCD panel 200 comprises a TFT array. In this embodiment, the display area 212 is divided into left and right areas—a first display area 212*a* and a second display area 212*b*, respectively. A non-display area 214 of the LCD panel 200 comprises a gate driver 220 and a source driver 225 for controlling transistors of the TFT array. The first display controller 230 and the second display controller 234 respectively output a first display control signal and a second display control signal to correspondingly control the gate driver 220 to generate a gate driving signal and control the source driver 225 to generate a source driving signal.

In this embodiment, since the display area 212 possesses a high resolution, the first display control signal outputted by the first display controller 230 displays a first image on the first display area 212*a*, and the second display control signal outputted by the second display controller 234 displays a second image on the second display area 212*b*. The first image and the second image are then combined to form a frame.

Upon receiving a video signal, the first display controller 230 retrieves pixel data associated with the first display area 212*a* from the video signal, and converts the retrieved pixel data to the first display signal. After that, from the retrieved pixel data, pixel data unrelated to the first display area 212*a* is outputted as a partial video signal. Upon receiving the partial video signal, the second display controller 234 converts data associated with the second display area 212*b* to the second display control signal to be outputted. Thus, the first display controller 230 divides the pixel data of the video signal into two parts—a first partial pixel data that is converted to the first display control signal, and a second partial pixel data that is converted to the partial video signal to be outputted to the second display controller 234. The second display controller 234 converts the partial video signal to the second display control signal. Therefore, a frame is displayed on the display area 212 of the LCD panel.

Considering an LCD panel with a larger scale, a display area of the LCD panel may be divided into left and right, and lower and upper areas—four display areas that are for displaying corresponding images. A plurality of display controllers can retrieve pixel data corresponding to a plurality of display areas, and the retrieved pixel data is processed to generate display control signals for displaying images on corresponding display areas.

For example, suppose that each of the red signal Red, green signal Green, and blue signal Blue has 10 bits. Therefore, including a vertical synchronization signal Vsync and a horizontal synchronization signal Hsync, the video signal comprises 32 signal lines. In response, the display controllers 230 and 234 in FIG. 2 require 32 pins to receive the 32 signal lines of the video signal and require 32 pins to output the partial video signal to subsequent display controllers. Accordingly, the present disclosure describes that a partial video signal is transmitted between display controllers with an improved double data rate, such that not only signal lines for the partial video signal are reduced but also pins of the display controllers are decreased.

Figure 3:
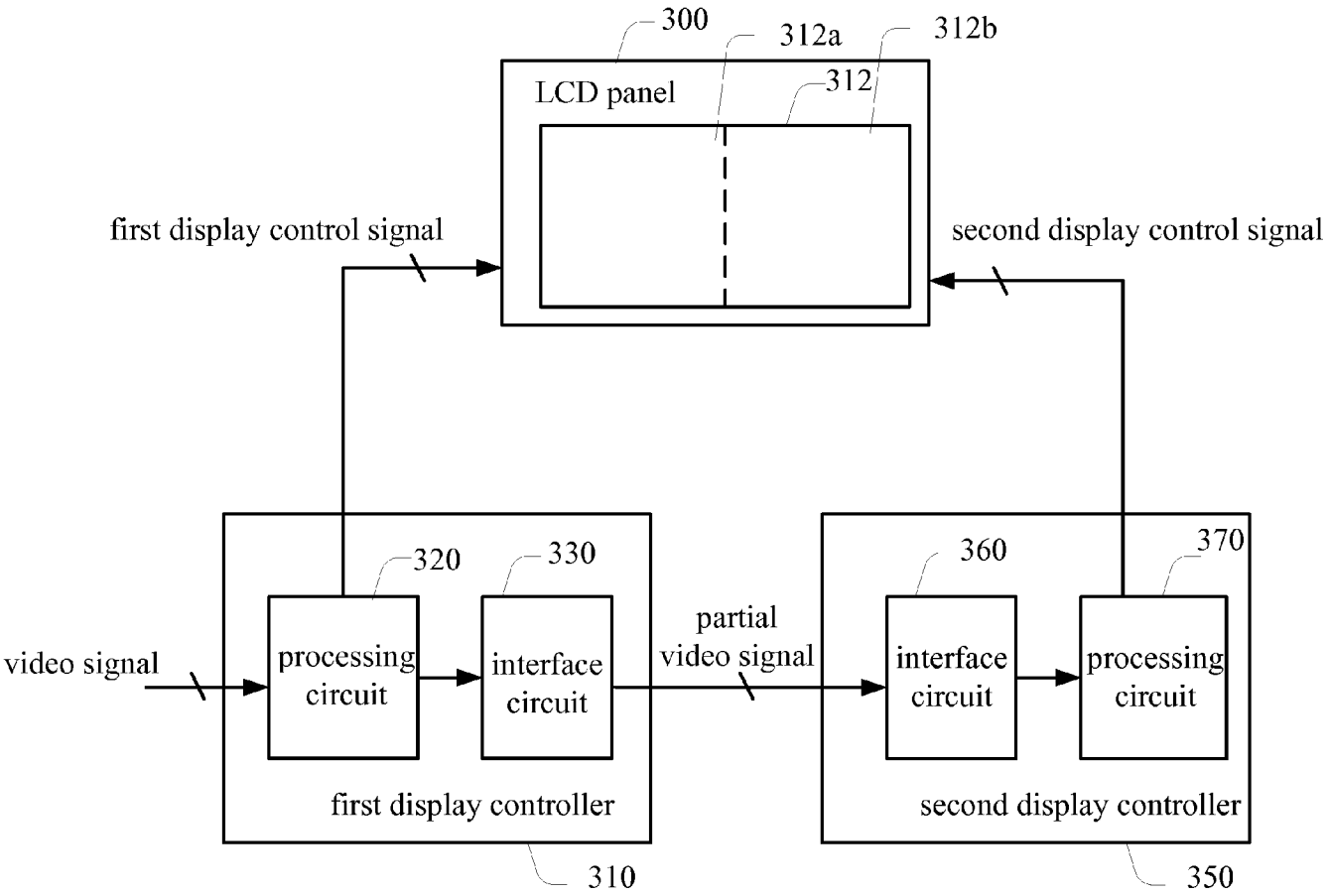
FIG. 3 is a schematic diagram of a large-scale LCD system in accordance with an embodiment of the present disclosure.

FIG. 3 shows a schematic diagram of a large-scale LCD system in accordance with an embodiment of the present disclosure. An LCD panel 300 displays a frame according to a first display control signal and a second display control signal. A first display controller 310 comprises a processing circuit 320 and a high speed interface circuit 330, and a second display controller 350 comprises a processing circuit 370 and a high speed interface circuit 360. When the processing circuit 320 receives a video signal, the first display controller 310 retrieves pixel data associated with a first display area 212*a* from the video signal, and converts the retrieved pixel data to the first display control signal to be outputted. From the retrieved pixel data, pixel data unrelated to the first display area 312*a* is transmitted to the high speed interface circuit 330 and is converted to a partial video signal.

The high speed interface circuit 360 of the second display controller 350 receives the partial video signal to retrieve the pixel data associated with the second display area 312*b*. Accordingly, the processing circuit 370 processes the pixel data associated with the second display area 312*b* to generate the second display control signal. Thus, the first display controller 310 divides the pixel data of the video signal into two parts—a partial pixel data that is converted to the fist display control signal by the processing circuit of the first display controller, and a second partial pixel data that is converted to a partial video signal by the high speed interface circuit 330. The high speed interface circuit 360 of the second display controller 350 receives and converts the partial video signal to a second partial pixel data, which is converted by the processing circuit 370 to the second display control signal. Preferably, the high speed interface circuits 330 and 360 of the display controller 310 and 350 transmit the partial video signal with double data rate transmission to effectively reduce pins of the two display controllers 310 and 350. For example, the information of the partial video signal comprises red, green and blue signals, a display enable (DE) signal, a horizontal synchronization signal Hsync, a vertical synchronization signal Vsync and clock signal. When the high speed interface circuits 330 and 360 in the display controllers 310 and 360 transmit the partial video signal with double data rate, the DE signal can indicate an active region, and the improved double data rate transmission structure may implement a free run without random access to transmit video data bulks. Preferably, a strobe signal is not required. Not only complexity of a phase lock loop (PLL) circuit is reduced but also a complicated handshake circuit may be eliminated. For example, when the partial video signal is transmitted with the improved double data rate structure, 30 bits are needed for realizing transmission of a 10-bit resolution video data comprising red, blue and green signals. In this embodiment, the DE signal, the horizontal synchronization signal Hsync, the vertical synchronization signal Vsync are packaged into the foregoing data to form a 33-bit data, which can be transmitted by 17 pins with the double data rate. To further include the foregoing clock signal pin, 18 pins are needed to realize serial transmission with the 10-bit video resolution. When a faster dual data rate transmission structure is applied, the number of the pins is further reduced or the resolution can be further increased.

Figure 4:
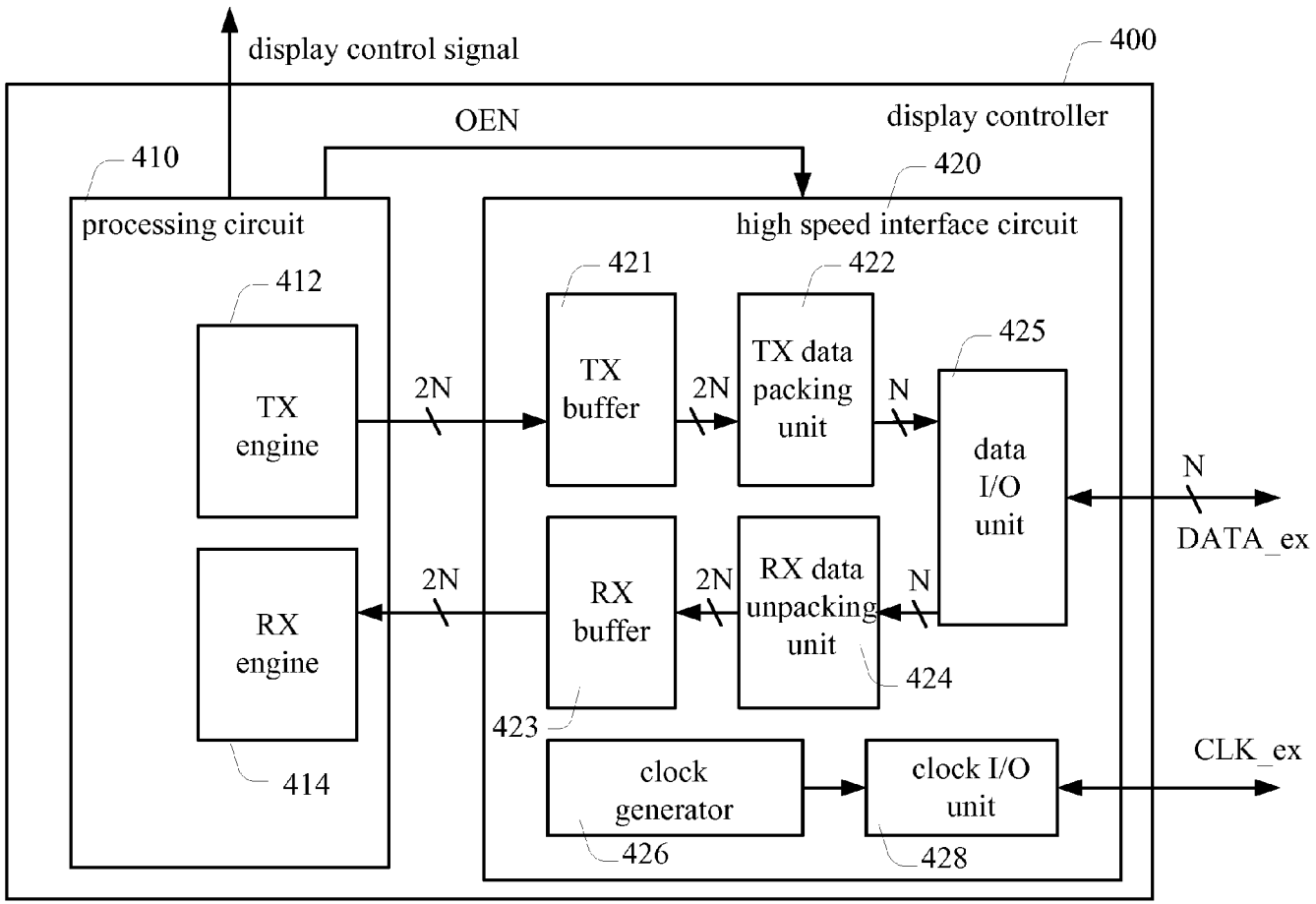
FIG. 4 is a circuit block diagram of a display controller in accordance with another embodiment of the present disclosure.

FIG. 4 shows a circuit block diagram of a display controller in accordance with an embodiment of the present disclosure. The display controller can serve as the above first display controller and second display controller. A display controller 400 comprises a processing circuit 410 and a high speed interface circuit 420. The processing circuit 410 comprises a transmitting (TX) engine 412, and a receiving (RX) engine 414. The high speed interface circuit 420 comprises a TX buffer 421, a TX data packaging unit 422, an RX buffer 423, a data input/output (I/O) unit 425, a clock generator 426, and a clock I/O unit 428. The TX buffer 421 and the TX data packaging unit 422 provide a TX channel, which operates according to an internal clock signal CLK_in generated by the clock generator 426. The RX buffer 423 and the RX data extracting unit 424 provide an RX channel, which operates according to an external clock CLK_ex received by the clock I/O unit 428.

When the display controller 400 in FIG. 4 operates as the first display controller, the TX engine 412 of the processing circuit 410 is activated whereas the RX engine 414 is deactivated. Moreover, the processing circuit 410 asserts an output enable signal (OEN) to activate the TX channel (i.e., the TX buffer 421 and the TX data packaging unit 422) of the high speed interface circuit 420 as well as the clock generator 426. The data I/O unit 425 and the clock I/O unit 428 output a data signal and a clock signal, and the RX channel (i.e., the RX buffer 423 and the RX data packaging unit 424) is deactivated. At this point, the TX buffer 421 and the TX data packaging unit 422 of the TX channel operate according to the internal clock signal CLK_in generated by the clock generator 426, which generates an external clock signal CLK_ex to the second display controller. In this embodiment, the partial video signal comprises an external data signal DATA_ex and the external clock signal CLK_ex.

When the display controller 400 in FIG. 4 operates as the second display controller, the RX engine 414 of the processing circuit 410 is activated whereas the TX engine 412 is deactivated. The processing circuit 410 disables the OES, such that the RX channel (i.e., the RX buffer 423 and the RX data extracting unit 424) of the high speed interface circuit 420 is activated, and the data I/O unit 425 and the clock I/O unit 428 receive a data signal and the external clock signal CLK_ex. The TX channel (i.e., the TX buffer 421 and the TX data packaging unit 422) and the clock generator 426 are deactivated. In this embodiment, the RX buffer 423 and the RX data packaging unit 424 of the RX channel operate according to the external clock signal CLK_ex of the partial video signal.

Figure 5:
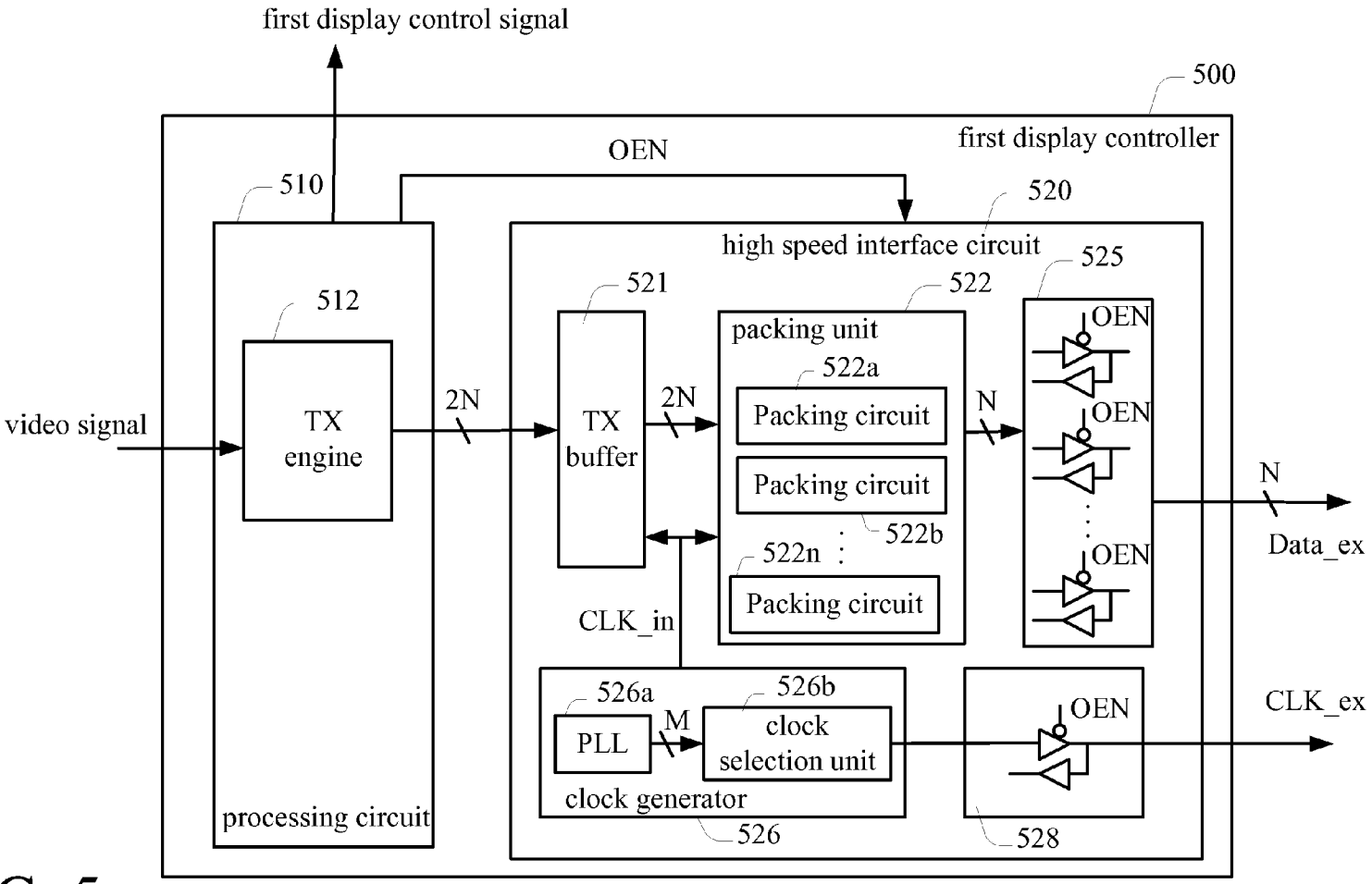
FIG. 5 is a circuit block diagram of a first display controller in accordance with yet another embodiment of the present disclosure.

FIG. 5 shows a circuit block diagram of the display controller in FIG. 4 operating as a first display controller. A clock generator 526 comprises a PLL 526*a* and a clock selection unit 526*b*. The PLL 526*a* generates M clock signals of a same frequency, and the clock selection unit 526*b* selects from the M clock signals one clock signal as an external clock signal CLK_ex, which is transmitted via a clock I/O unit 528.

The first display controller 500 processes a first partial pixel data of a video signal to generate a first display control signal, and a second partial pixel data is transmitted to a high speed interface circuit 520 via a TX engine 512. A TX buffer 521 of the high speed interface circuit 520 can balance a speed difference between a processing circuit 510 and the high speed interface circuit 520. For example, the TX buffer may be a first-in-first-out (FIFO).

Referring to FIG. 5, the second partial pixel data outputted by the TX engine 512 and the TX buffer 521 is provided with 2N signal lines. A TX data packaging unit 522 packages the second pixel data in the 2N signal lines to N signal lines of a double data rate, and an external data signal DATA_ex is outputted by a data I/O unit 525.

Figure 6A:
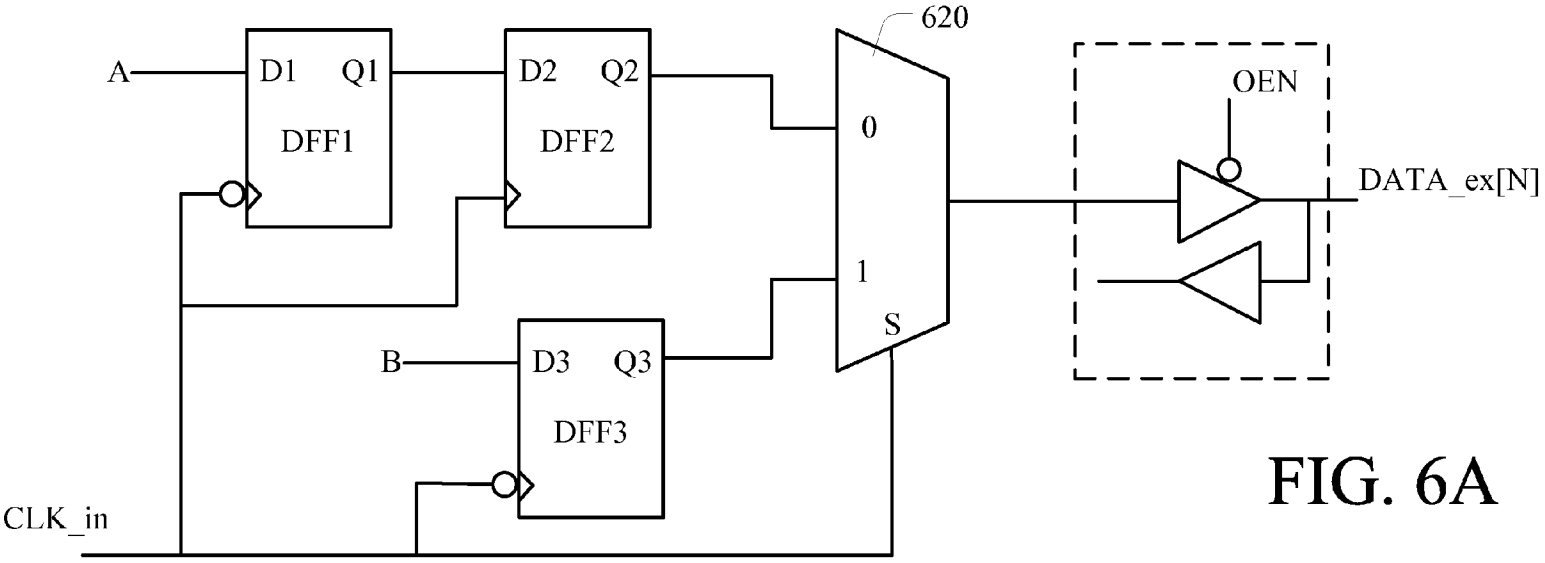
FIG. 6A and FIG. 6B show a circuit diagram of an Nth packaging circuit and signal conversion thereof.
Figure 6B:
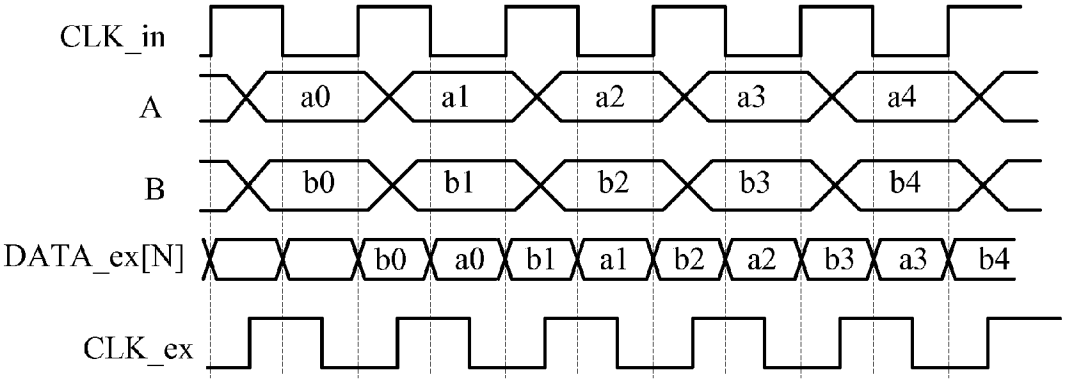

In this embodiment, the TX data packaging unit 522 comprises N packaging units 522*a* to 522*n*. Each of the packaging units 522*a* to 522*n* can package two bit lines of the second partial pixel data to one bit line of the partial video signal. FIG. 6A and FIG. 6B show a circuit diagram of an Nth packaging circuit and related signal conversion thereof. The Nth packaging circuit 522*n* comprises three D-type flip-flops DFF 1, DFF2 and DFF3, and a multiplexer 620. The first D-type flip-flop DFF 1 and the third D-type flip-flop DFF3 are negative edge triggered, and the second D-type flip-flop DFF2 is positive edge triggered. Each of the three D-type flip-flops DFF 1, DFF2 and DFF3 receives an internal clock signal CLK_in at its clock input end.

The first D-type flip-flop DFF1 receives an Ath bit signal at its input end D1, and has its output end Q1 coupled to an input end D2 of the second D-type flip-flop DFF2. The second D-type flip-flop DFT2 has its output end Q2 coupled to an input end 0 of the multiplexer 620. The third D-type flip-flop DFF3 has its input end D3 for receiving a Bth bit signal, and its output end Q3 coupled to an input end 1 of the multiplexer 620. The multiplexer 620 has a select end S for receiving the internal clock signal CLK_in, and switches between the signals inputted at its input ends according to the clock signal CLK_in.

Referring to FIG. 6B, while an OEN signal is enabled (e.g., a low level), the data I/O unit 525 outputs an Nth bit of the external data signal DATA_ex[N], which has a data transmission rate twice that of the Ath bit signal and the Bth bit signal. The external clock signal CLK_ex selected by the clock selection unit 526*b* of the clock generator is outputted via the clock I/O unit 528, and rising edges and falling edges of the external clock signal CLK_ex sample the Nth bit of the external data signal DATA_ex[N].

Figure 7:
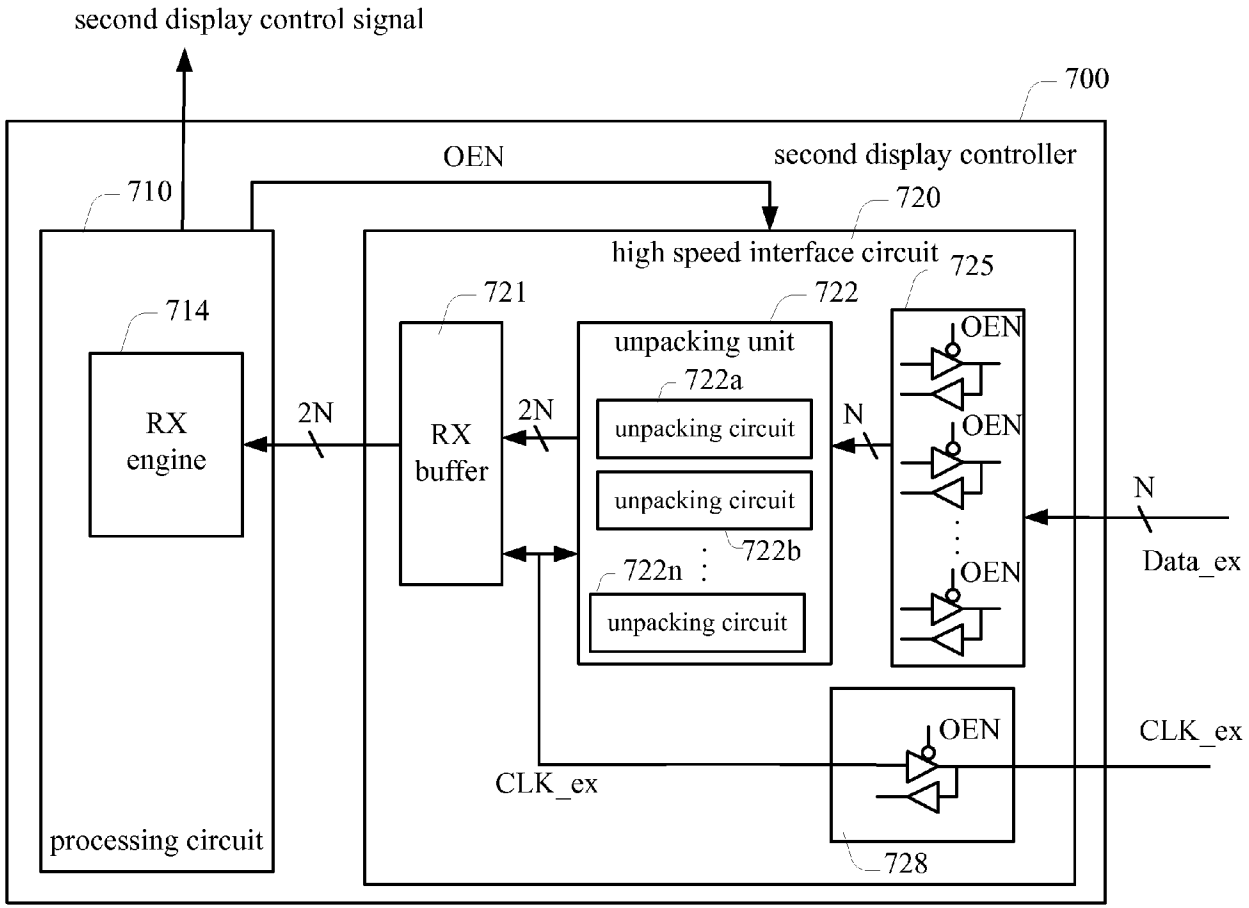
FIG. 7 is a circuit block diagram of a second display controller.

FIG. 7 shows a circuit block diagram of the display controller in FIG. 4 operating as a second display controller 700. In this embodiment, the second display controller 700 receives a partial video signal via a data I/O unit 725 and an RX data packaging unit 722 in a high speed interface circuit 720, and converts an external data signal DATA_ex having N taps to a second partial pixel data having 2N taps. An RX buffer 721 of the high speed interface circuit 720 balances a speed difference between a processing circuit 710 and the high speed interface circuit 720. Preferably, the RX buffer unit 721 may be a FIFO. Referring to FIG. 7, an RX engine 714 and the RX buffer unit 721 respectively comprise 2N signal taps to receive the second partial pixel data.

Figure 8A:
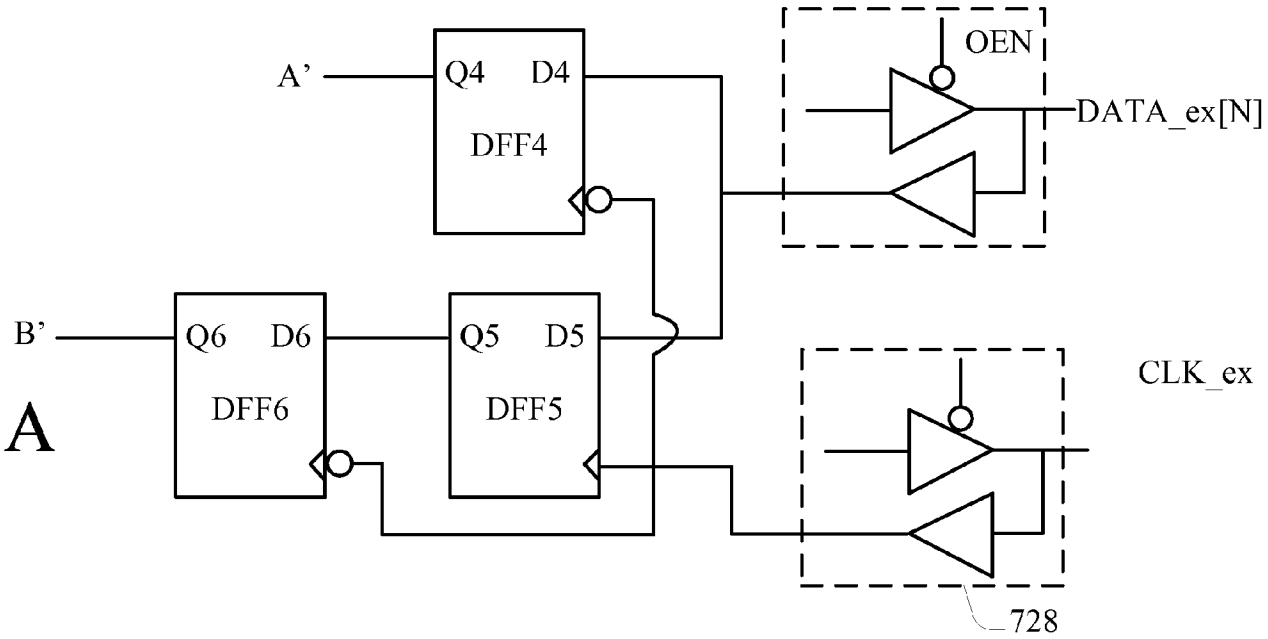
FIG. 8A and FIG. 8B show a circuit diagram of an Nth extracting unit and signal conversion thereof.
Figure 8B:
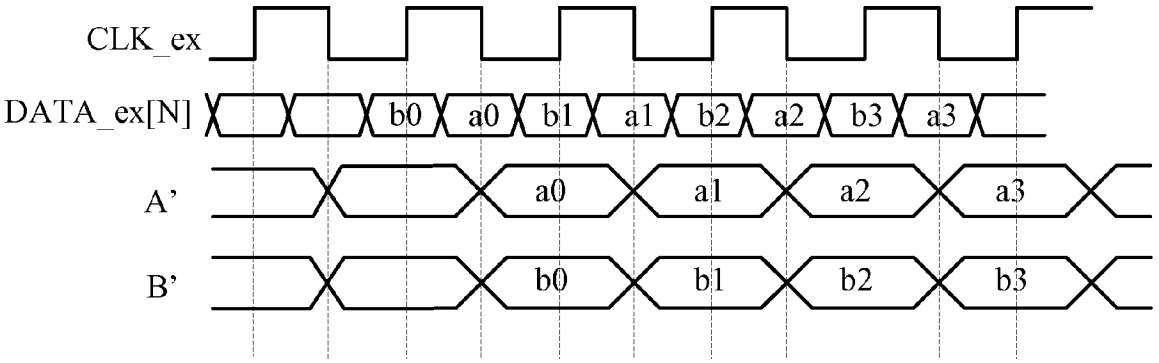

In this embodiment, the RX data extracting unit 722 comprises N extracting units 722*a* to 722*n*, each of which can extract one bit line of the partial video signal to two bit lines for the second partial pixel data. FIGS. 8A and 8B show a circuit diagram of an Nth extracting unit and signal conversion thereof. The N extracting circuit 722*n* comprises three D-type flip-flops DFF4, DFF5 and DFF6. The fourth D-type flip-flop DFF4 and the sixth D-type flip-flop DFF6 are negative edge triggered, and the fifth D-type flip-flop DFF5 is positive edge triggered. The three D-type flip-flops DFF4, DFF5 and DFF6 respectively have an input end for receiving an external clock signal CLK_ex via a clock I/O unit 728.

The fourth D-type flip-flop DFF4 receives an Nth bit of the external data signal DATA_ex[N] at its input end D4, and outputs an A'th bit signal at its an output end Q4 via the data I/Q unit 725. The fifth D-type flip-flop DFF5 receives the Nth bit of the external data signal DATA_ex[N] at its input end D5, and has its output end Q5 coupled to an input end D6 of the sixth D-type flip-flop DFF6, which outputs a B'th bit signal at its output end Q6.

As observed from FIG. 8B, since an OEN signal is disabled (e.g., being at a high level), the clock I/O unit 728 receives the external clock signal CLK_ex. Likewise, since the OEN signal is disabled, the data I/O unit 725 receives the Nth bit of the external data signal DATA_ex[N]. According to the external clock signal CLK_ex, the Nth external data signal DATA_ex[N] is accurately sampled to an A'th bit signal and a B'th bit signal. In this embodiment, the Nth bit of the external data signal DATA_ex has a data transmission rate twice that of the A'th bit signal and the B'th bit signal.

Figure 9:
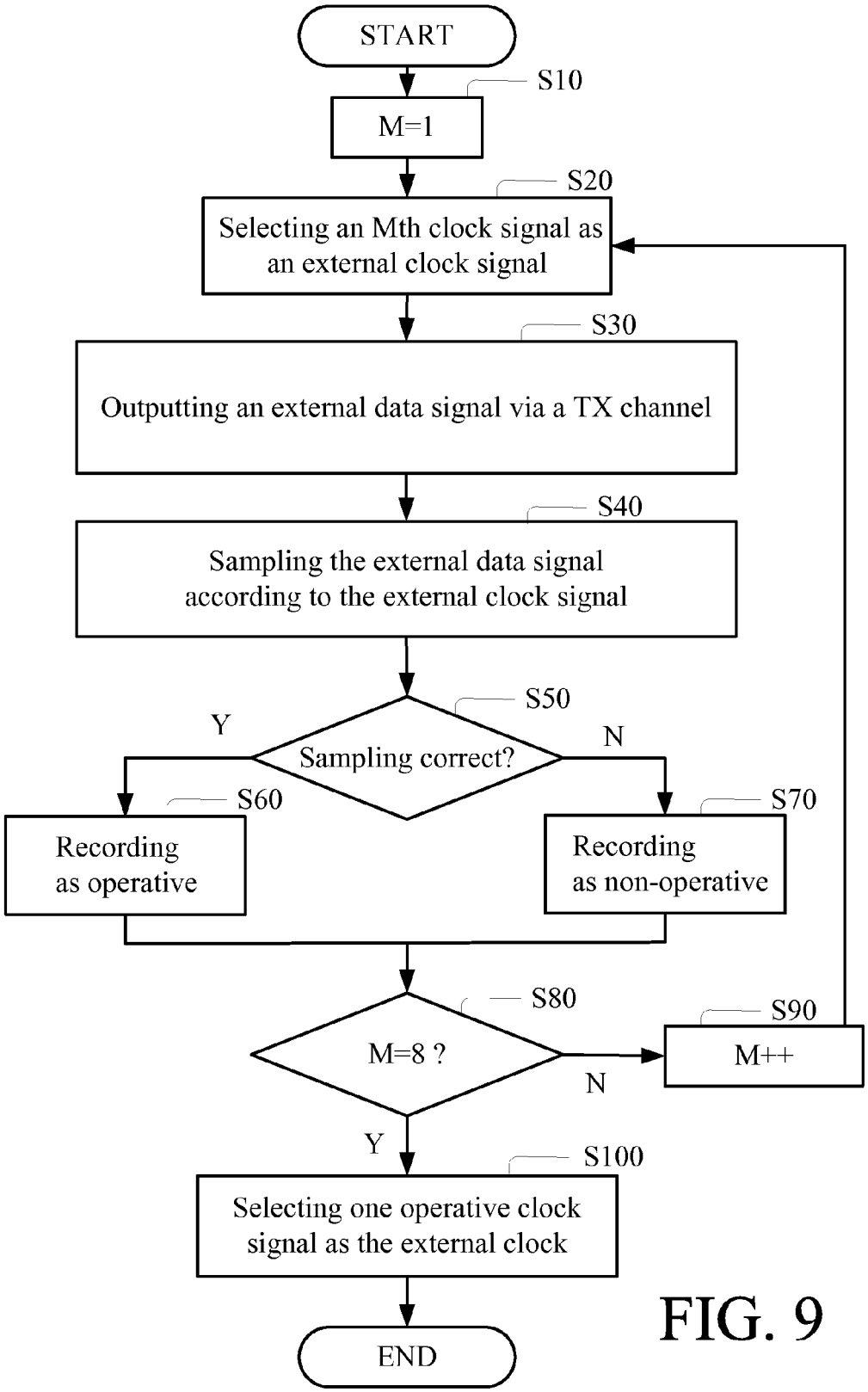
FIG. 9 is a flow of selecting a clock signal.

FIG. 9 shows a flow chart of a clock selection method according to one embodiment of the present disclosure. Suppose that the PLL 526*a* in FIG. 5 is capable of producing eight clock signals, with a same frequency, each having a predetermined phase difference of 45 degrees. In Step S10, when a first display controller and a second display controller are initialized, M is defined as 1. In Step S20, the first display controller selects an Mth clock signal as an external clock signal. In Step S30, the first display controller outputs an external data signal via a TX channel. In Step S40, the second display controller samples the external data signal according to the external clock signal. In Step S50, it is determined that whether the sampling is accurate.

When the determination result of Step S50 is positive, the flow proceeds to Step S60 in which the Mth clock signal is recorded as being operative. When the determination result of Step S70 is negative, the flow performs Step S70 in which the Mth clock signal is recorded as being non-operative.

After that, in Step S80, it is determined whether M is equal to 8. When M is not equal to 8, M is incremented by 1 in Step S90 and the flow returns to Step S20. When M is equal to 8, the flow proceeds to Step S100 in which one from a plurality of operative clock signals is selected as the external clock. Therefore, when the initialization is completed, the external clock signal generated by the first display controller may determine a plurality of clock phases that are operative to accurately sample the external data signal. Preferably, a middle one of the operative clock signals is applied as the external clock signal, or a chip producer may program the middle one into manufactured chips via a test procedure.

For example, supposing that a fifth clock signal, a sixth clock signal and a seventh clock signal among 8 clock signals can accurately sample the external data signal, the sixth clock signal is preferably selected for the external clock signal. Preferably, the foregoing flowchart is performed at initialization of the first display controller and the second display controller. Alternatively, the flowchart may be performed by a display controller in the manufacturing factory, and a proper clock phase is selected and programmed. The display controller is shipped to a client end to apply the display controller with good clock phase. Preferably, the external clock signal and the external data signal are free-run external clock signal and external data signal. For example, dummy external data signals are continuously generated when the first display controller receives no video signal, and the second display controller does not receive while receiving the dummy external data signals, such that no handshake circuit is required to simplify the required circuits.

Therefore, the present disclosure provides a video signal transmission method applied to display controllers to transmit a partial video signal between the display controllers with multiple data rate, so that signal lines needed by the partial video signal are substantially reduced and thereby reducing pins for coupling the display controllers as advantages thereof.

While the present disclosure has been described in terms of what is presently considered to be the most practical and preferred embodiments, it is to be understood that the present disclosure needs not to be limited to the above embodiments. On the contrary, it is intended to cover various modifications and similar arrangements included within the spirit and scope of the appended claims which are to be accorded with the broadest interpretation so as to encompass all such modifications and similar structures.

What is claimed is:

1. A method implemented in a first display controller, the method comprising:

receiving, by a processing circuit of the first display controller, a video signal;

converting, by the processing circuit, a first partial pixel data of the video signal to output a first display control signal, the first display control signal including data displayed in a first portion of a frame;

generating, by a clock generator of an interface circuit of the first display controller, an external clock signal; and processing, by the interface circuit, a second partial pixel data of the video signal to output a partial video signal to a second display controller, the partial video signal being outputted together with the external clock signal, the partial video signal including data displayed in a second portion of the frame, the first and the second portions being different portions of the frame, wherein the partial video signal comprises a data enable (DE) signal, a horizontal synchronization signal, a vertical synchronization signal, a red data, a blue data and a green data, and wherein the partial video signal is transmitted with a multiple data rate per clock cycle of the external clock signal such that a number of signal lines needed by the partial video signal is reduced.

2. The method as claimed in claim 1, further comprising:

receiving the partial video signal and the external clock signal by the second display controller;

retrieving the second partial pixel data from the partial video signal according to the external clock signal by the second display controller; and converting the second partial pixel data to a second display control signal and outputting the second display control signal by second display controller.

3. The method as claimed in claim 2, further comprising:

displaying the frame according to the first display control signal and the second display control signal by a liquid crystal display (LCD) panel.

4. The method as claimed in claim 1, further comprising:

applying a clock signal from a plurality of clock signals in sequence as the external clock signal to output a test data signal by the first display controller;

recording a plurality of operative clock signals from the plurality of clock signals according to a sampling result by sampling the test data signal by the second display controller; and selecting one operative clock signal from the plurality of operative clock signals as the external clock signal.

5. An apparatus, comprising:

a first display controller that receives a video signal and converts a first partial pixel data of the video signal to a first display control signal that includes data displayed in a first portion of a frame, and converts a second partial pixel data of the video signal to a partial video signal according to an internal clock signal, the partial video signal being outputted together with an external clock signal generated by a clock generator of the first display controller; and a second display controller that receives the partial video signal and the external clock signal, converts the partial video signal to the second partial pixel data, and converts the second partial pixel data to a second display control signal that includes data displayed in a second portion of the frame, the first and the second portions being different portions of the frame, wherein the first display control signal and the second display control signal are used to control an LCD panel to display the frame, wherein the partial video signal comprises a data enable (DE) signal, a horizontal synchronization signal, a vertical synchronization signal, a red data, a blue data and a green data, and wherein the partial video signal is transmitted with a multiple data rate per clock cycle of the external clock signal such that a number of signal lines needed by the partial video signal is reduced.

6. The apparatus as claimed in claim 5, wherein the partial video signal is transmitted with a multiple data rate with reference with the external clock signal.

7. The apparatus as claimed in claim 5, wherein the first display controller comprises a TX channel that converts the second partial pixel data to the partial video signal, and outputs the partial video signal.

8. The apparatus as claimed in claim 7, wherein the TX channel comprises:

a TX buffer that temporarily stores the second partial pixel data; and a TX data packaging unit that converts the second pixel data outputted by the TX buffer to the partial video signal with a multiple data rate.

9. The apparatus as claimed in claim 8, wherein the TX data packaging unit comprises a data packaging circuit that packages two bit lines for the second partial pixel data to one bit line for the partial video signal.

10. An apparatus, comprising:

a display controller comprising:

a clock generator, for generating an external clock signal;

a processing circuit, for receiving a video signal, processing a first partial pixel data of the video signal to output a first display control signal, and outputting a second partial pixel data of the video signal; and an interface circuit, for receiving the second partial pixel data from the processing circuit, and outputting a partial video signal together with the external clock signal according to the second partial pixel data to another display controller to output a second display control signal accordingly, wherein the first display control signal comprises data displayed in a first portion of a frame and the second display control signal comprises data displayed in a second portion of the frame, and wherein the interface circuit comprises a packing unit that packages the second partial pixel data into the partial video signal.

11. The apparatus as claimed in claim 10, wherein the second partial pixel data is in 2N signal lines and the partial video signal is in N signal lines.

12. The apparatus as claimed in claim 11, wherein each signal line of the second partial pixel data is a single data rate signal and each signal line of the partial video signal is a double data rate signal.

13. The apparatus as claimed in claim 10, wherein the packing unit packaging two bit lines of the second partial pixel data into one bit lines of the partial video signal.

14. The apparatus as claimed in claim 10, wherein the clock generator generates an internal clock signal to the packing unit, and wherein the packing unit packages the second partial pixel data into the partial video signal according to the transitions of the internal clock signal.

* * * * *